US006149876A

United States Patent [19]

Galloway

[11] Patent Number: 6,149,876

[45] Date of Patent: Nov. 21, 2000

[54] APPARATUS FOR RECLAMATION OF GLYCOL BASED LIQUIDS USED IN GAS DEHYDRATION

[75] Inventor: Anthony John Galloway, Calgary, Canada

[73] Assignee: Presson Manufacturing Ltd., Nisku, Canada

[21] Appl. No.: 09/141,046

[22] Filed: Aug. 27, 1998

[30] Foreign Application Priority Data

Jun. 8, 1998 [CA] Canada ..... 2239984

[51] Int. Cl.[7] ..... F28D 21/00; F23B 5/02; F23C 9/00; F16K 1/00; F16K 5/00

[52] U.S. Cl. ..... 422/173; 422/198; 422/234; 110/204; 137/872; 137/876; 2551/304

[58] Field of Search ..... 422/173, 176, 422/198, 234, 235; 110/204; 137/872, 876; 251/327, 304, 326; 95/153, 254, 256; 96/218

[56] References Cited

U.S. PATENT DOCUMENTS

| | | | |
|---|---|---|---|
| 3,654,962 | 4/1972 | Fredd et al. | 137/625.11 |
| 4,026,681 | 5/1977 | Roskelley | 95/189 |
| 4,147,762 | 4/1979 | Steiner | 423/569 |
| 4,280,416 | 7/1981 | Edgerton | 110/254 |
| 4,474,118 | 10/1984 | Benedick | 110/211 |
| 5,141,536 | 8/1992 | Schievelbein et al. | 96/242 |
| 5,205,137 | 4/1993 | Ohuchi et al. | 62/484 |
| 5,630,366 | 5/1997 | Lesoille | 110/221 |
| 5,685,243 | 11/1997 | Gohara et al. | 110/345 |

*Primary Examiner*—Marian C. Knode
*Assistant Examiner*—Alexa A. Doroshenk
*Attorney, Agent, or Firm*—Davis & Bujold

[57] ABSTRACT

A method and apparatus for reclamation of glycol based liquids used in gas dehydration. A first step involves providing an thermal oxidizer and a reboiler. A second step involves providing a dual stream valve having a first outlet, a second outlet and means for adjusting the relative flow through the first outlet and the second outlet. A third step involves placing the dual stream valve on an exhaust gas outlet of the thermal oxidizer and coupling the first outlet to an exhaust stack and the second outlet to the reboiler. The fourth step involves diverting through the second outlet of the dual stream valve such exhaust gases flowing through the exhaust gas outlet of the thermal oxidizer as may be required to provide heat necessary to operate the reboiler.

5 Claims, 18 Drawing Sheets

APPARATUS FOR RECLAMATION OF GLYCOL BASED LIQUIDS USED IN GAS DEHYDRATION

FIELD OF THE INVENTION

The present invention relates to a method and an apparatus for reclamation of glycol based liquids used in gas dehydration

BACKGROUND OF THE INVENTION

Natural gas, which is a naturally occurring material, contains water vapour as part of it's constituent make-up at the production temperature and pressure. This water vapour causes some operational problems in the production of natural gas and, as such, it must be removed from the natural gas. The removal of the water from the natural gas is called "dehydration" of the natural gas.

A common form of natural gas dehydration involves the use of glycol based liquids. These liquids, such as ethylene, diethylene or triethylene glycol, form a molecular bond with the water molecules in the natural gas. The glycol based liquids allow the water molecules to move from the gas phase to the glycol liquid phase thus dehydrating the natural gas. This process is most commonly done in a gas to liquid contractor.

The glycol which now contains water (called "rich glycol") must be processed to remove the water. This process of water removal from the rich glycol is called "reclamation" of the glycol. The glycol reclamation process involves the heating of the rich glycol to excite the water to glycol bond thus releasing the water molecule from the glycol molecule. The heating process occurs in a vessel called a "reboiler" and requires a significant amount of energy in the form of heat. The glycol, once free of water (called "lean glycol"), can be reintroduced into the dehydration process to collect more water from the natural gas.

The lean glycol, as it comes in contact with the natural gas, not only absorbs water molecules, but also absorbs other molecules that are naturally occurring in the natural gas. These other molecules, such as hydrocarbons (C1 to C10), carbon dioxide, benzene, toluene, ethyl benzene, xylene, hydrogen sulphide, mercaptans, and other sulphur compounds are also released from the glycol during the reclamation process. These other molecules released during the reclamation process are commonly called "fugitive emissions". It is common that these fugitive emissions are released directly to atmosphere. It is known that some of these fugitive emissions are toxic to humans, some are considered non-threshold carcinogens, and some are highly flammable. In order to avoid environmental contamination, steps are now being taken to direct fugitive emissions from glycol reclamation through a thermal oxidizer. Oxidization of the fugitive emissions is also requires a significant amount of energy in the form of heat.

SUMMARY OF THE INVENTION

What is required is an energy saving method and associated apparatus for reclamation of glycol based liquids used in gas dehydration.

According to one aspect the present invention there is provided a method for reclamation of glycol based liquids used in gas dehydration. A first step involves providing an thermal oxidizer and a reboiler. A second step involves providing a dual stream valve having a first outlet, a second outlet and means for adjusting the relative flow through the first outlet and the second outlet. A third step involves placing the dual stream valve on an exhaust gas outlet of the thermal oxidizer and coupling the first outlet to exhaust means and the second outlet to the reboiler. The fourth step involves diverting through the second outlet of the dual stream valve such exhaust gases flowing through the exhaust gas outlet of the thermal oxidizer as may be required to provide heat necessary to operate the reboiler.

When fugitive emissions are thermally oxidized, they release energy in the form of heat. The heat of combustion or oxidation of these fugitive emissions is greater than the heat required to excite the water to glycol bond of the rich glycol in the reboiler. When heat produced as a result of the thermal oxidization of the fugitive emissions is used, the need to purchase fuel for the reboiler is eliminated. This substantially reduces the cost of the glycol reclamation process.

According to another aspect of the present invention there is provided an apparatus for reclamation of glycol based liquids used in gas dehydration which includes an thermal oxidizer having an exhaust gas outlet. A dual stream valve is positioned on the exhaust gas outlet of the thermal oxidizer. The dual stream valve has a first outlet, a second outlet and means for adjusting the relative flow of exhaust gases through the first outlet and the second outlet. Exhaust means, such as a flue stack, are coupled to the first outlet. A reboiler is coupled to the second outlet. Exhaust gases diverted by the dual stream valve from the thermal oxidizer through the second outlet provide the heat necessary to operate the reboiler.

When the apparatus, as described above, is in operation there is no problem in drawing sufficient heat from the thermal oxidizer to operate the reboiler. The problem in placing the method into practise relates to harnessing the intense heat in the thermal oxidizer, only a relatively small portion of which will be required by the reboiler. Due to the intense heat many dual stream valves are unsuited for the application. Two operable embodiments will hereinafter be further described. A first embodiment uses a slide gate valve. A second embodiment uses a rotary gate valve.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

The preferred method for reclamation of glycol based liquids used in gas dehydration will now be described with reference to FIGS. 1 through 33. A first embodiment of apparatus will be described with reference to FIGS. 1 through 25. A second embodiment of apparatus will be described with reference to FIGS. 26 through 33.

Figure 1:
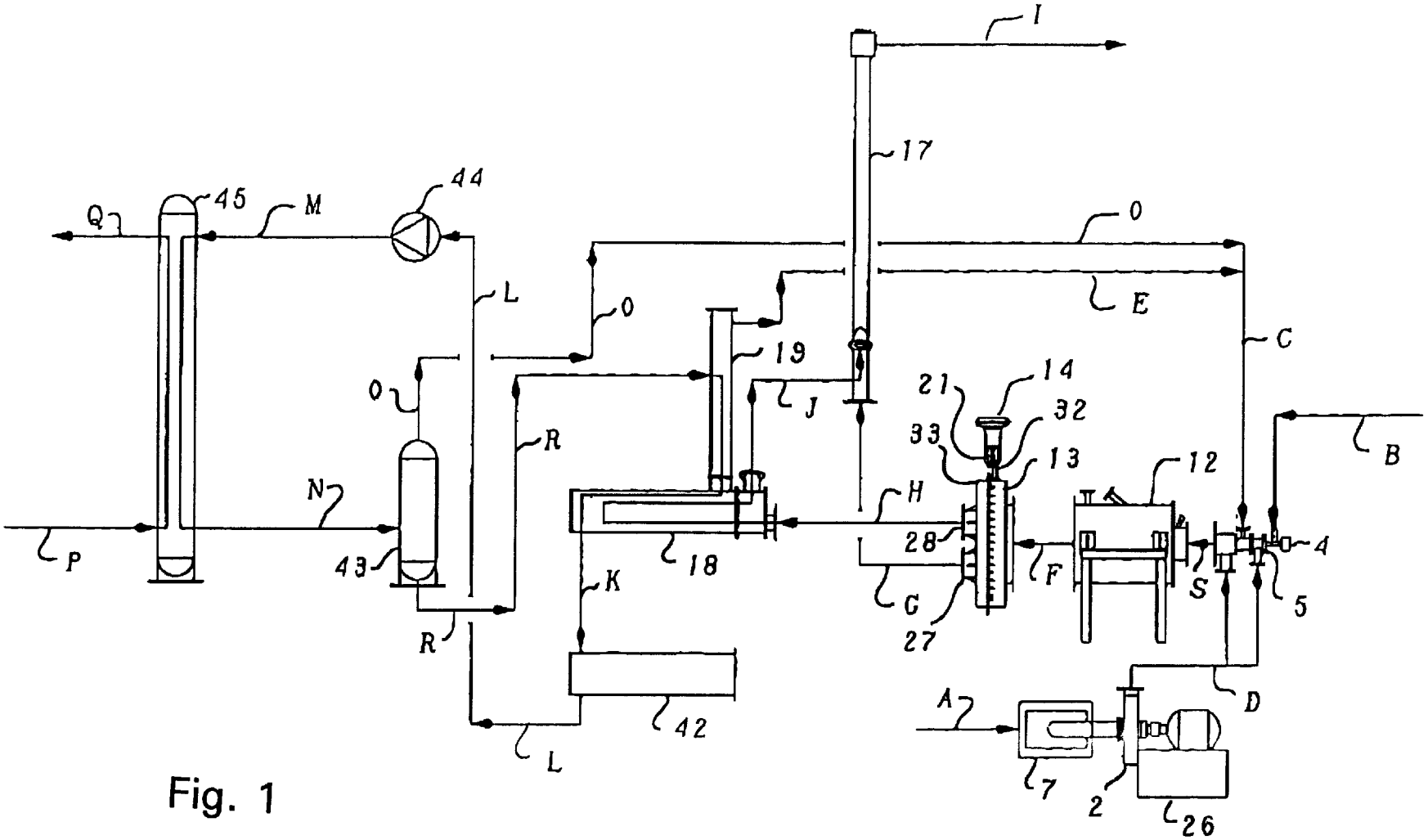
FIG. 1 is a flow diagram of a preferred method for reclamation of glycol based liquids used in gas dehydration in accordance with the teachings of the present invention in association with a first embodiment of an apparatus.
Figure 2:
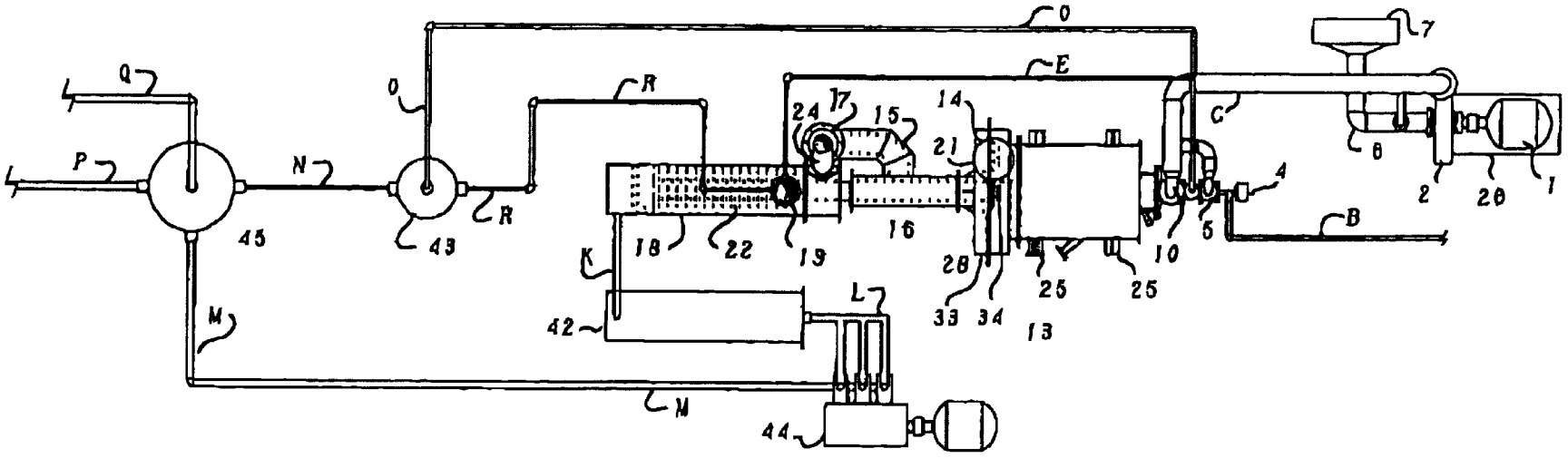
FIG. 2 is a top plan view of the first embodiment of an apparatus for reclamation of glycol based liquids illustrated in FIG. 1.
Figure 3:
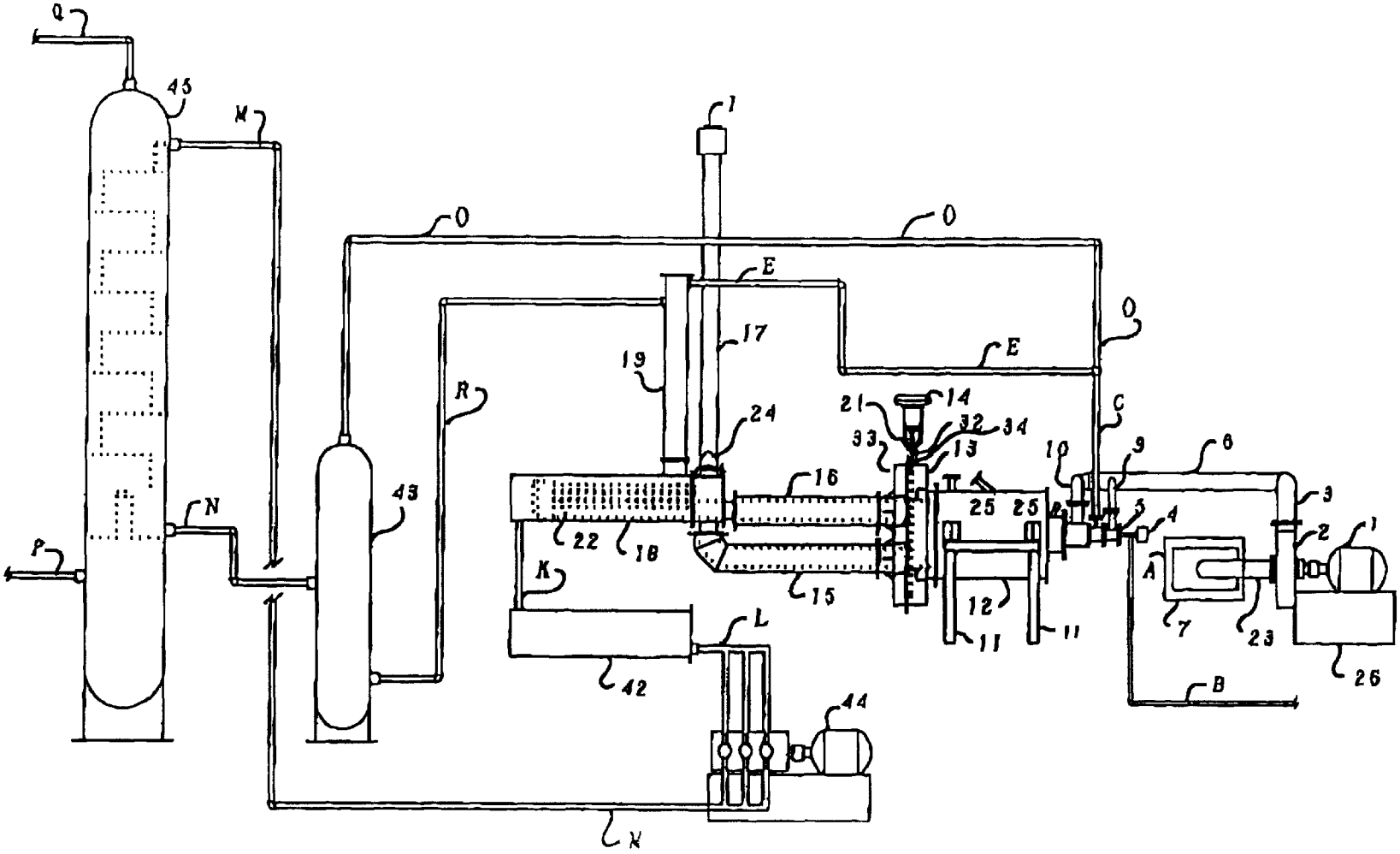
FIG. 3 is a left side elevation view of the first embodiment of an apparatus for reclamation of glycol based liquids illustrated in FIG. 1.

Referring to FIGS. 1 through 3, the general arrangement of the first embodiment of apparatus is illustrated with a horizontally oriented thermal oxidizer 12. The primary components illustrated include the air blower (2), the burner (5), the thermal oxidizer (12), the slide gate assembly (13) and the reboiler (18) as they would appear in operation. Other components illustrated include blower drive motor 1, blower housing 2, blower outlet air line 3, burner igniter 4, burner 5, pilot air line 6, blower filter 7, still column gas line E, flash tank gas line O, combustion air line 9, mass transfer line 10, oxidizer stand 11, oxidizer 12, slide gate assembly front housing 13, slide gate actuator 14, stack duct 15, reboiler duct 16, flue stack 17, reboiler 18, still column 19, slide gate 20, actuator arm 21, reboiler tube bundle 22, blower inlet duct 23, reboiler duct 24, oxidizer support bracket 25, blower support 26, slide gate assembly lower gas outlet 27, slide gate assembly upper outlet 28, slide gate inlet seal 29, slide gate lower outlet seal 30, slide gate upper outlet seal 31, slide gate actuator support 32, slide gate assembly rear housing 33, and slide gate stuffing box 34.

Figure 4:
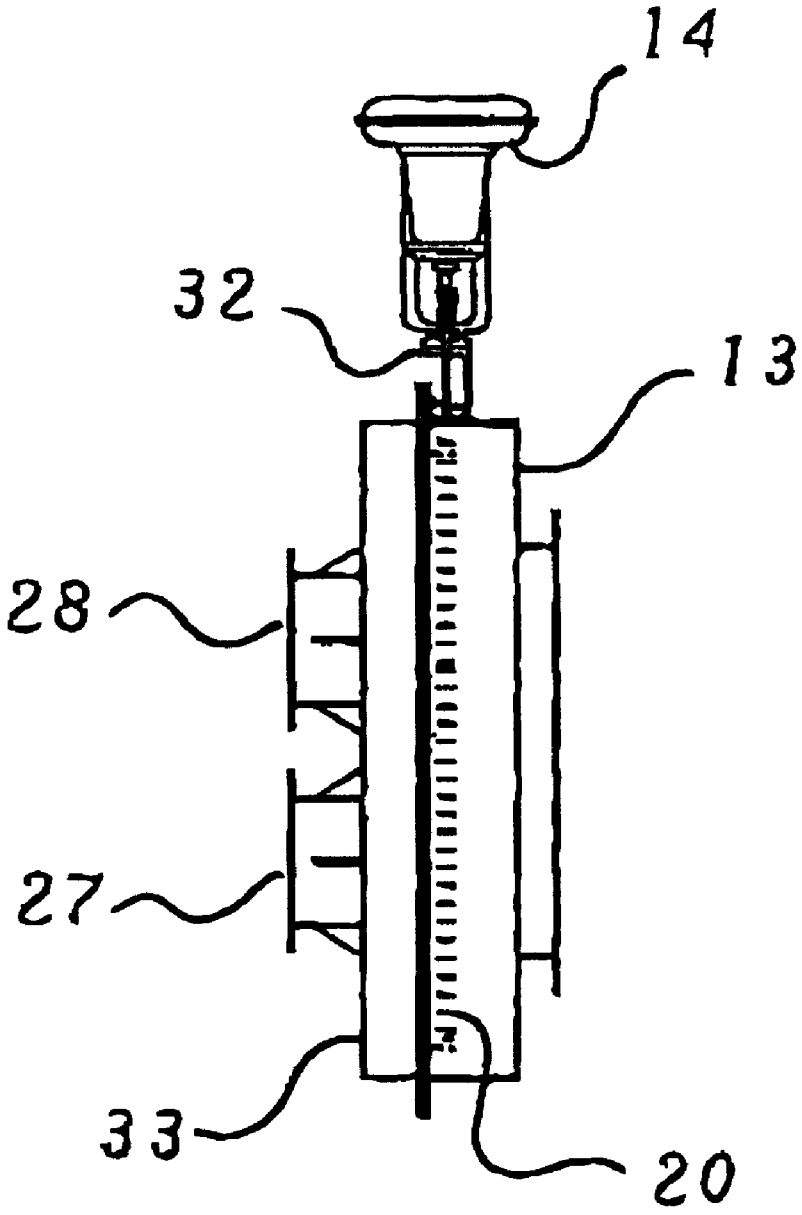
FIG. 4 is a left side elevation view of a slide gate actuated dual stream valve used in the first embodiment of an apparatus for reclamation of glycol based liquids illustrated in FIG. 1.
Figure 5:
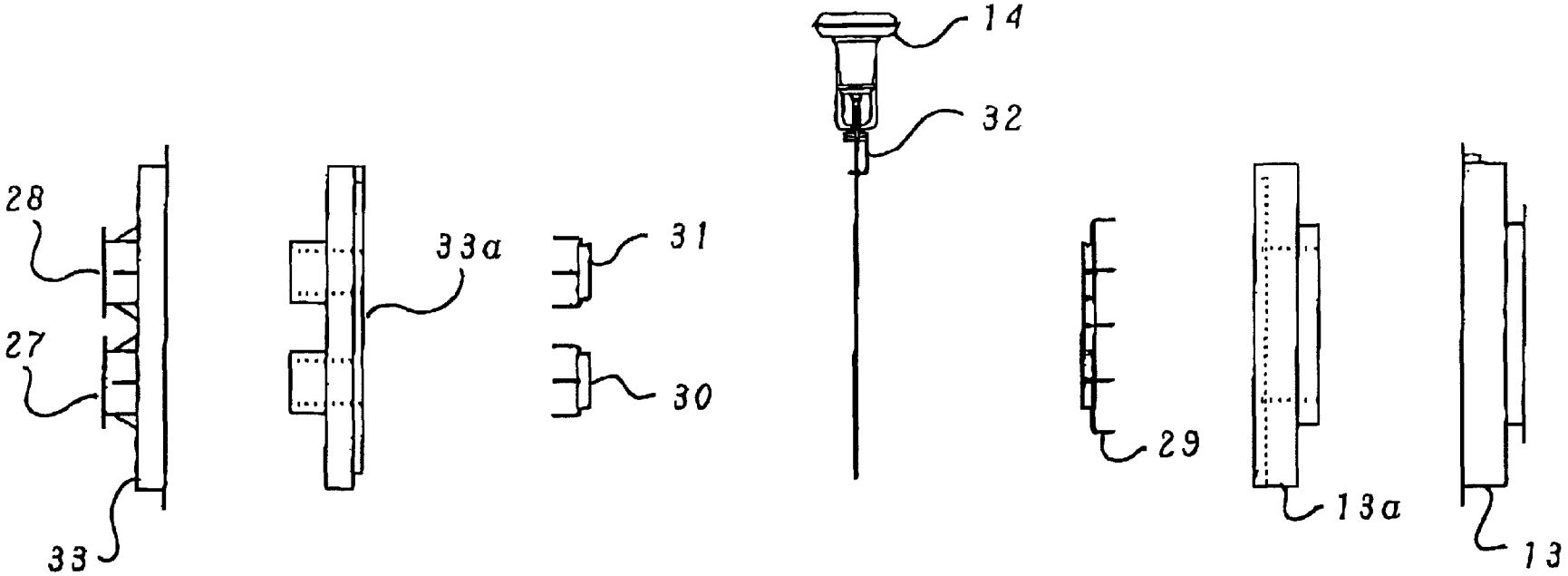
FIG. 5 is an exploded left side elevation view of the slide gate actuated dual stream valve illustrated in FIG. 4.
Figure 6:
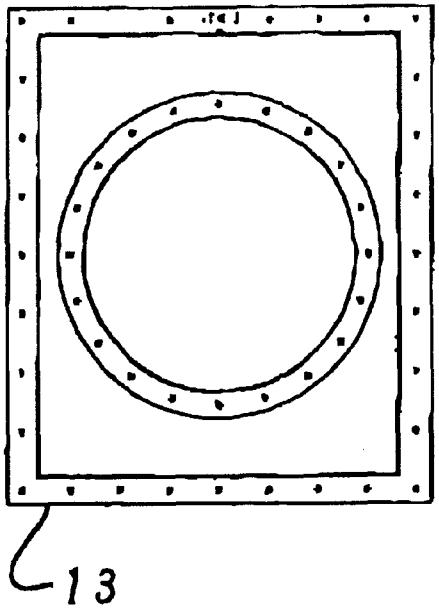
FIG. 6 is a front elevation view of a front housing from the slide gate actuated dual stream valve illustrated in FIG. 5.
Figure 7:
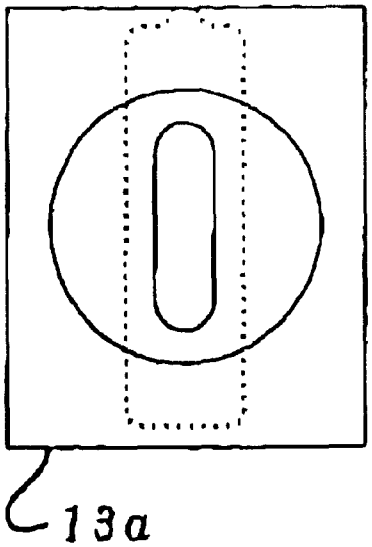
FIG. 7 is a front elevation view of a front housing refractory liner from the slide gate actuated dual stream valve illustrated in FIG. 5.
Figure 8:
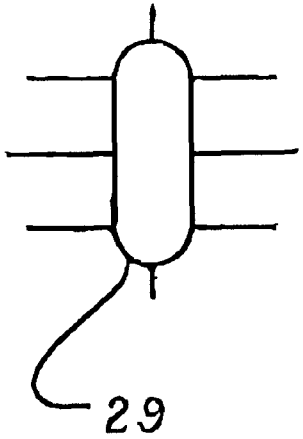
FIG. 8 is a front elevation view of a front housing slide gate seal from the slide gate actuated dual stream valve illustrated in FIG. 5.
Figure 9:
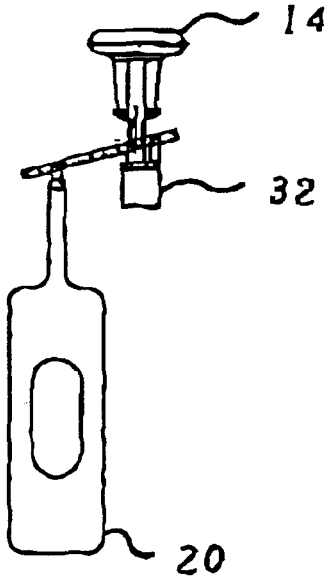
FIG. 9 is a front elevation view of a slide gate and slide gate actuator from the slide gate actuated dual stream valve illustrated in FIG. 5.
Figure 10:
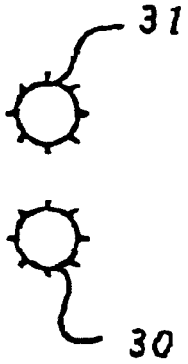
FIG. 10 is a rear elevation view of a outlet seal from the slide gate actuated dual stream valve illustrated in FIG. 5
Figure 11:
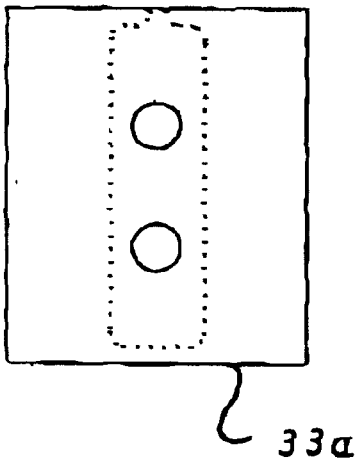
FIG. 11 is a rear elevation view of a rear housing refractory liner from the slide gate actuated dual stream valve illustrated in FIG. 5.
Figure 12:
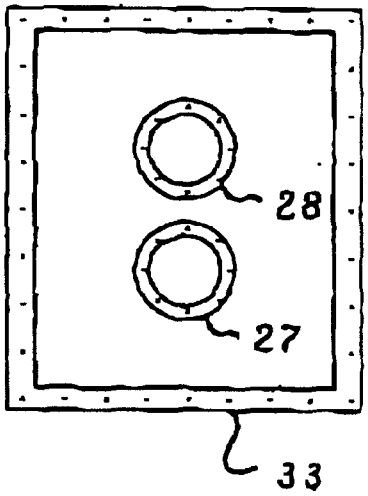
FIG. 12 is a rear elevation view of a rear housing from the slide gate actuated dual stream valve illustrated in FIG. 5.

Referring to FIGS. 4 and 5, the slide gate assembly is further illustrated. The components of the slide gate assembly include a front housing 13 illustrated in FIG. 6, front housing refractory liner 13a illustrated in FIG. 7, front housing slide gate seal 29 illustrated in FIG. 8, slide gate 20, slide gate actuator 14, and slide gate actuator support bracket 32 all illustrated in FIG. 9, slide gate rear housing lower seal 30 and upper seal 31 illustrated in FIG. 10, slide gate rear housing refractory liner 33a illustrated in FIG. 11, and slide gate rear housing 33 with first outlet 27 and second outlet 28 illustrated in FIG. 12.

Figure 13:
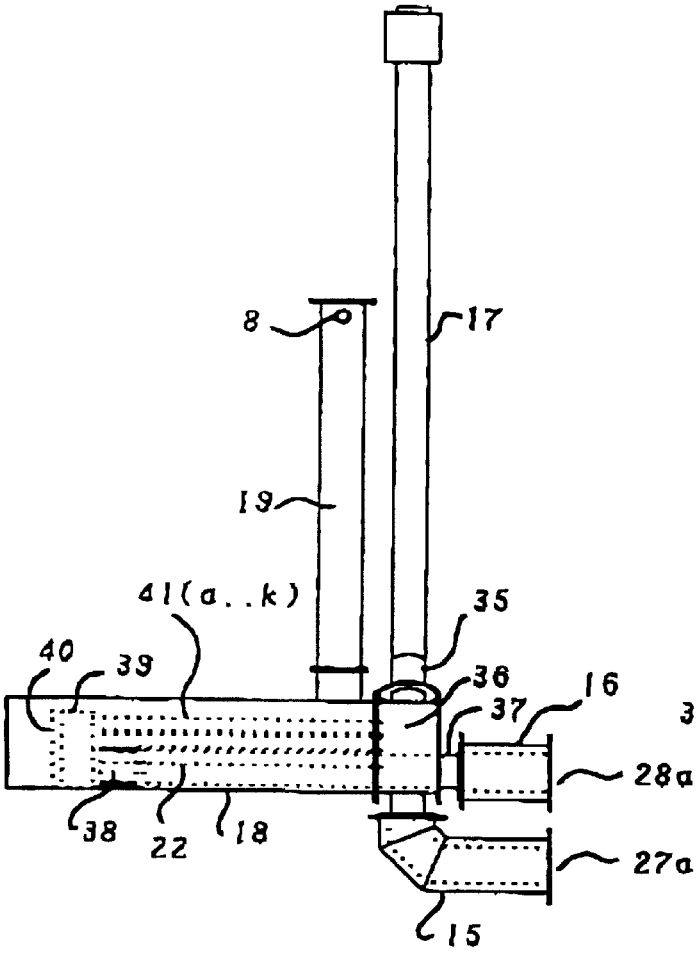
FIG. 13 is a left side elevation view of a reboiler with attached still column and stack used in the first embodiment of an apparatus for reclamation of glycol based liquids illustrated in FIG. 1.
Figure 14:
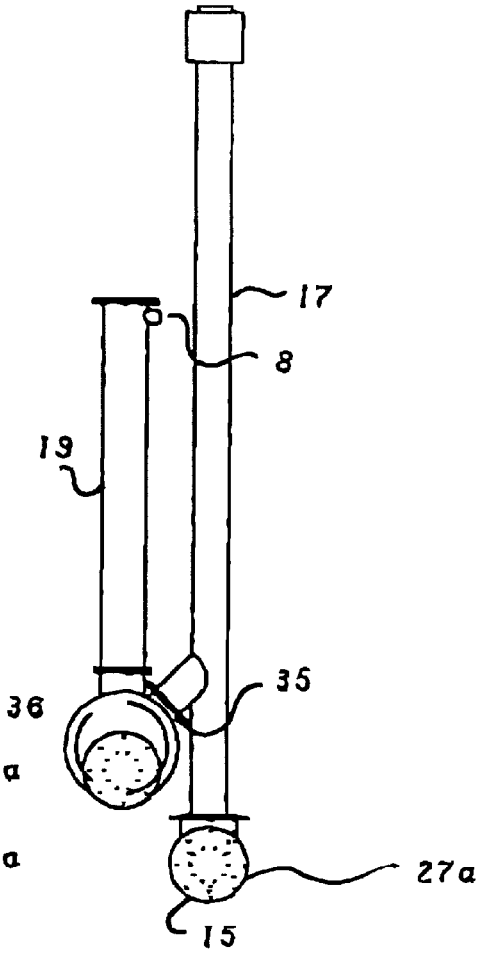
FIG. 14 is a front elevation view of the reboiler illustrated in FIG. 13.
Figure 17:
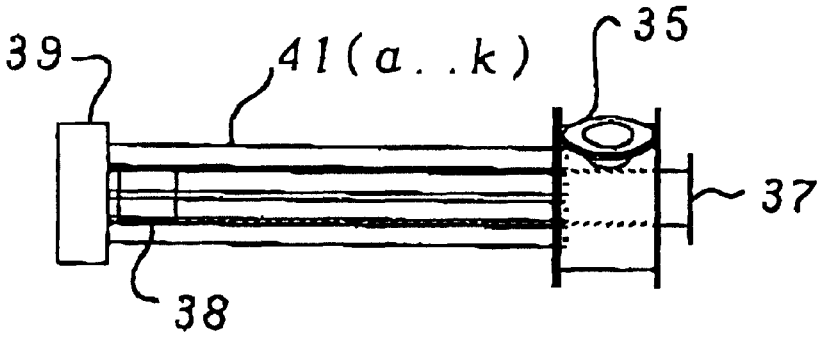
FIG. 17 is a top plan view of the reboiler illustrated in FIG. 16.
Figure 16:
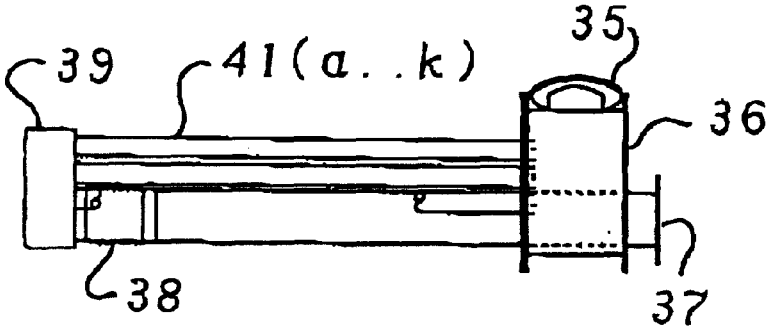
FIG. 16 is a left side elevation view of the reboiler used in the first embodiment of an apparatus for reclamation of glycol based liquids illustrated in FIG. 1.
Figure 15:
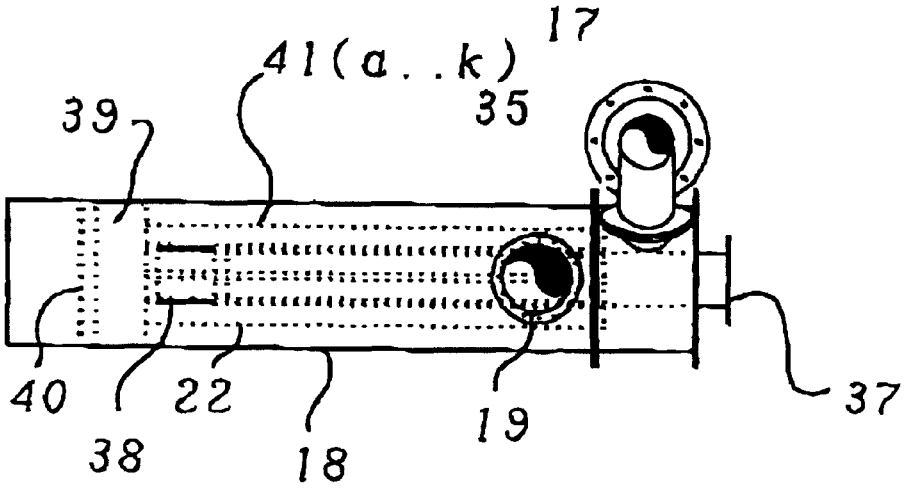
FIG. 15 is a top plan view of the reboiler illustrated in FIG. 13.
Figure 18:
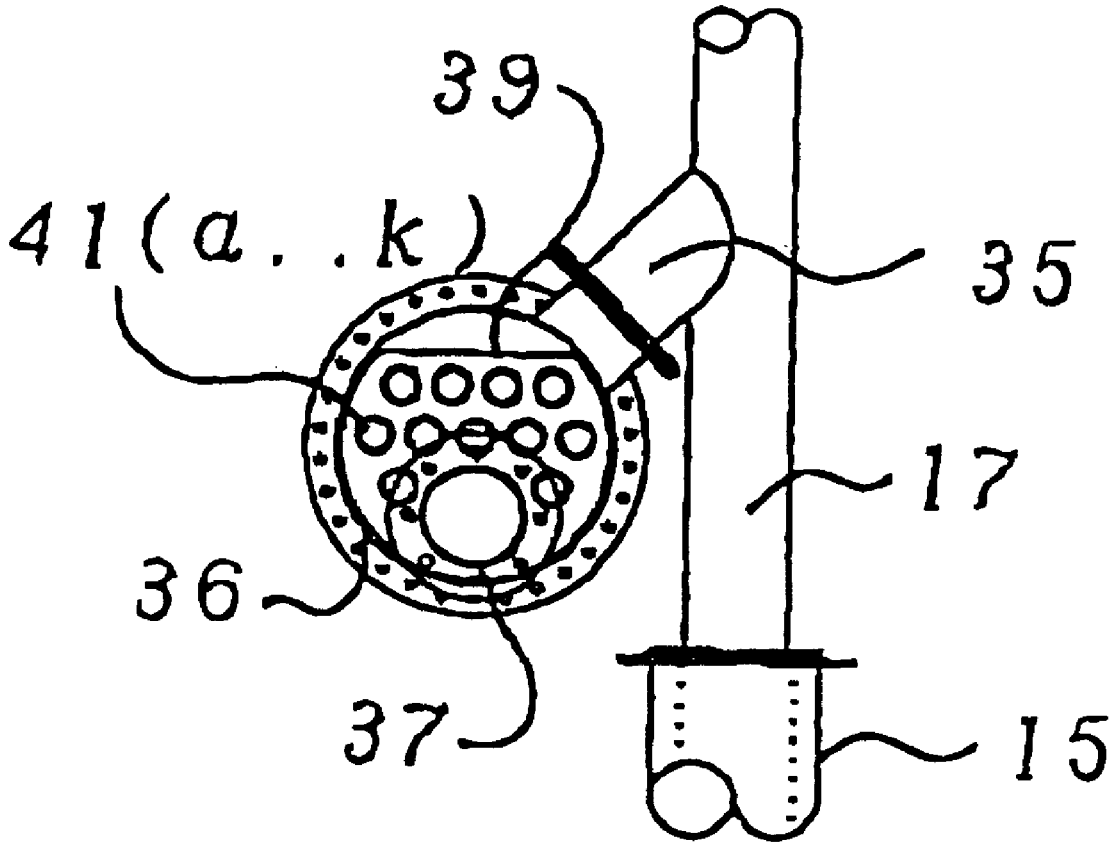
FIG. 18 is a front elevation view of the reboiler illustrated in FIG. 16.

Referring to FIGS. 13 through 18 further detail is provided regarding the reboiler 18. Referring to FIGS. 13 and 15, the components associated with the reboiler 18 include still column outlet nozzle 8, lower gas duct 15, upper gas duct 16, flue stack 17, still column 19, primary fire tube duct 22, lower gas duct flange 27*a*, upper gas duct flange 28*a*, reboiler gas duct 35, reboiler fire tube manifold 36, primary fire tube inlet nozzle 37, expansion bellows 38, fire tube bulk head 39, reboiler baffle 40, secondary fire tube(s) 41 a. .k. Referring to FIGS. 16 through 18, with particular regard to FIG. 18 secondary fire tubes 41 are further illustrated.

Figure 21:
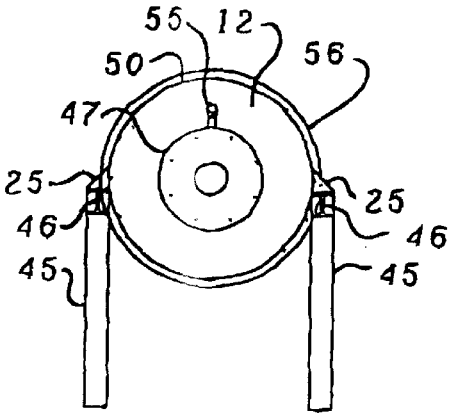
FIG. 21 is a front elevation view of the thermal oxidizer illustrated in FIG. 16.
Figure 20:
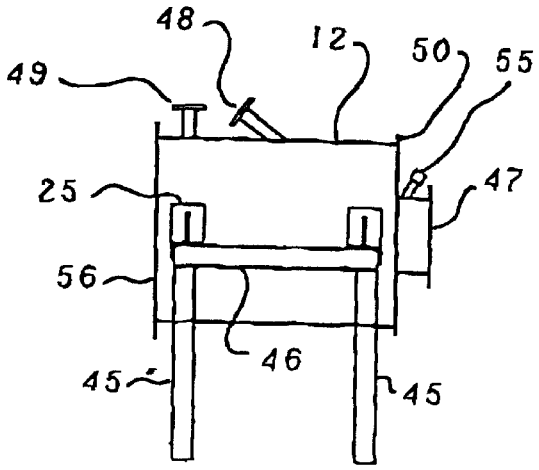
FIG. 20 is a left side elevation view of the thermal oxidizer illustrated in FIG. 16.
Figure 19:
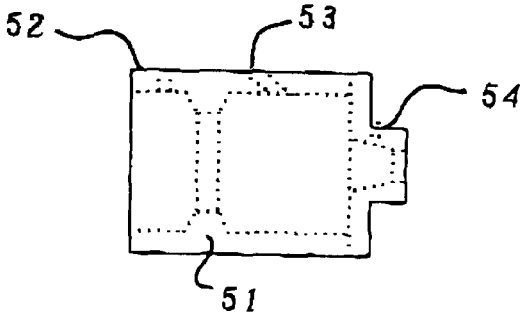
FIG. 19 is a left side elevation view of a refractory liner for a thermal oxidizer used in the first embodiment of an apparatus for reclamation of glycol based liquids illustrated in FIG. 1, with internal detail shown in broken lines.

Referring to FIGS. 19 through 21, thermal oxidizer 12 is further illustrated. Referring to FIGS. 20 and 21, the components of the oxidizer include oxidizer support bracket 25, oxidizer support legs 45, oxidizer support frame 46, and burner support nozzle 47. Referring to FIG. 20, further components include oxidizer front face 55, oxidizer rear flange 56, site nozzle 48 and temperature nozzle 49 and flame safe guard nozzle 50. Referring to FIG. 19, oxidizer 12 has a oxidizer refractory liner 51, temperature port 52, site port 53, and flame safeguard port 54.

Figure 22:
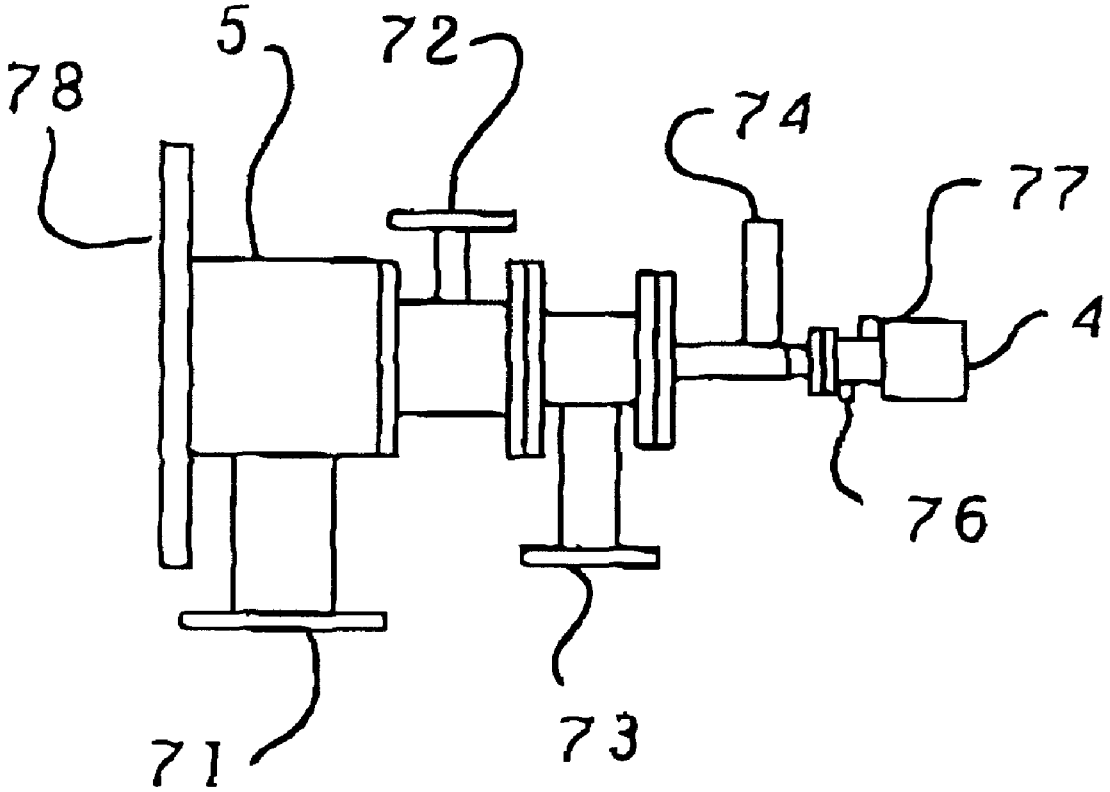
FIG. 22 is a left side elevation view of a burner used in the first embodiment of an apparatus for reclamation of glycol based liquids illustrated in FIG. 1.

Referring to FIG. 22, burner 5 is further illustrated. The components of the burner 5 includes waste gas combustion air nozzle 71, waste gas nozzle 72, fuel gas combustion air nozzle 73, fuel gas nozzle 74, igniter 4, pilot gas nozzle 76, pilot air nozzle 77, and support flange 78.

Figure 26:
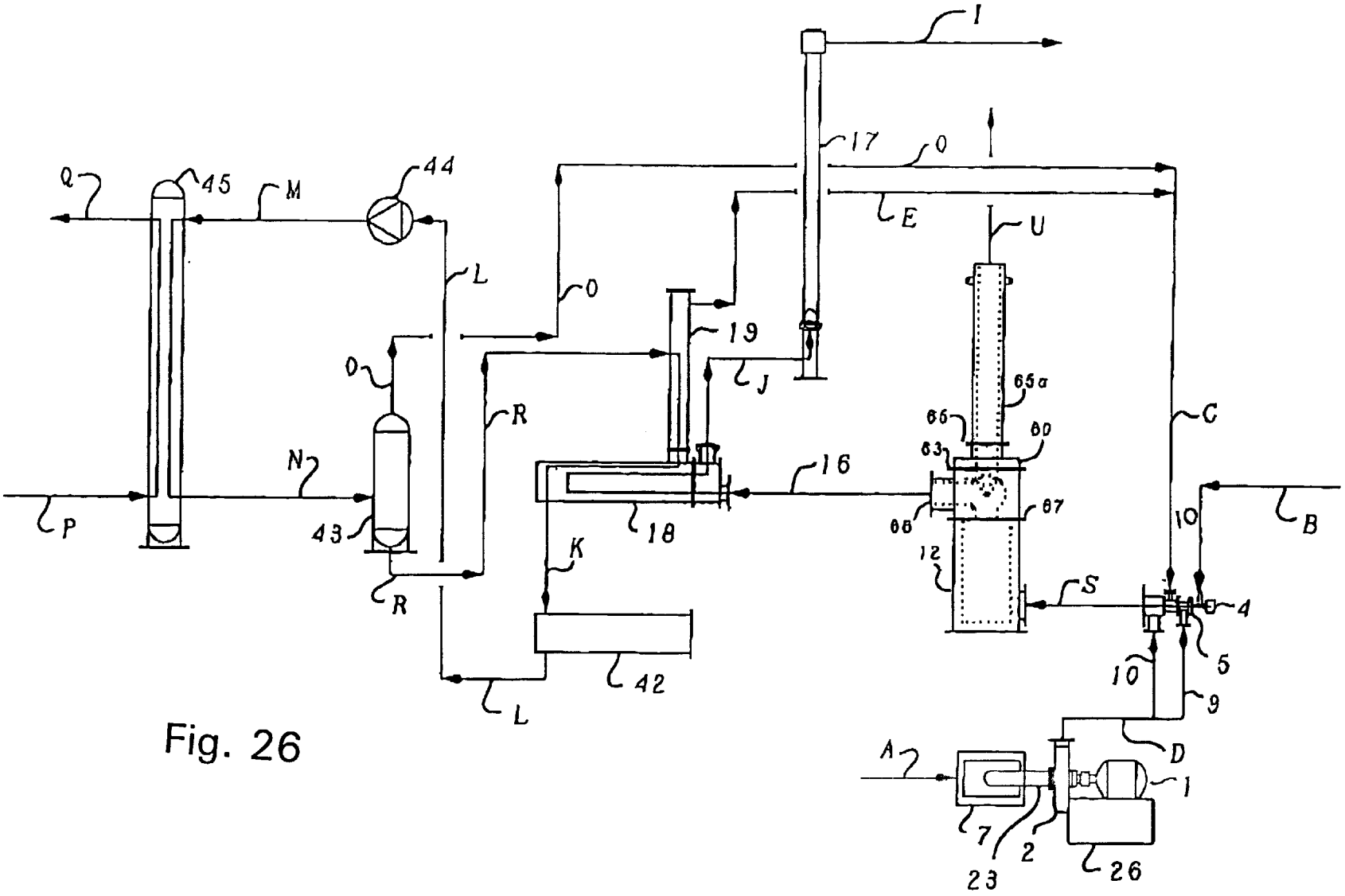
FIG. 26 is a flow diagram of a preferred method for reclamation of glycol based liquids used in gas dehydration in accordance with the teachings of the present invention in association with a second embodiment of an apparatus.
Figure 27:
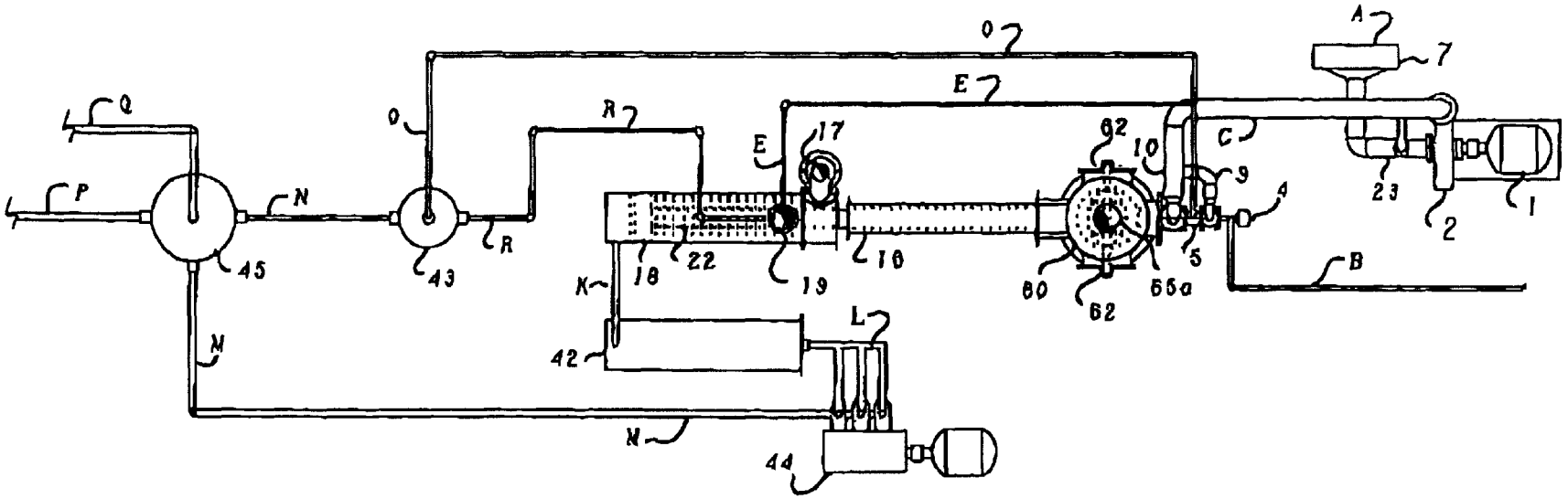
FIG. 27 is a top plan view of the second embodiment of apparatus for reclamation of glycol based liquids illustrated in FIG. 26.
Figure 28:
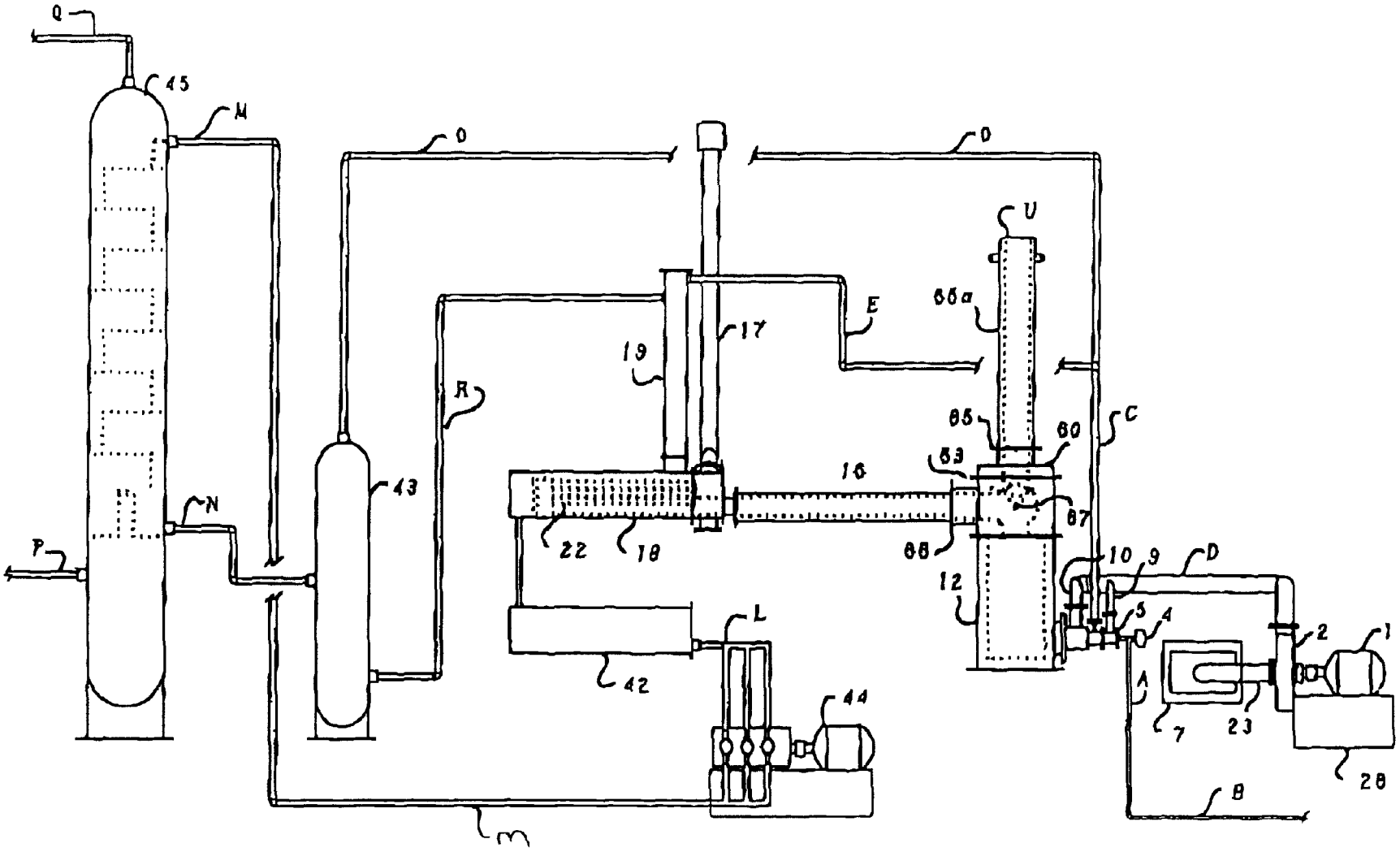
FIG. 28 is a left side elevation view of the second embodiment of apparatus for reclamation of glycol based liquids illustrated in FIG. 26.
Figure 29:
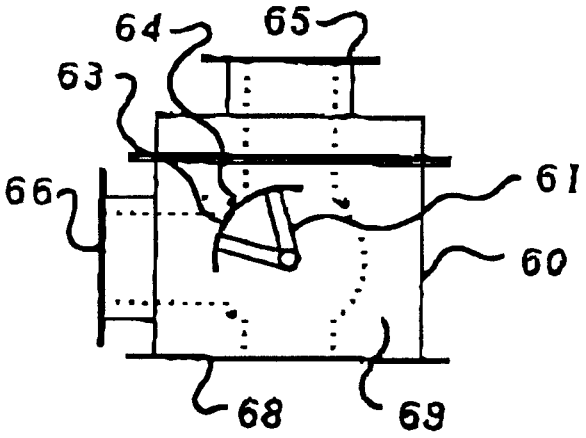
FIG. 29 is a left side elevation view, in section, of a rotary gate actuated dual stream valve used in the second embodiment of apparatus for reclamation of glycol based liquids illustrated in FIG. 1.
Figure 30:
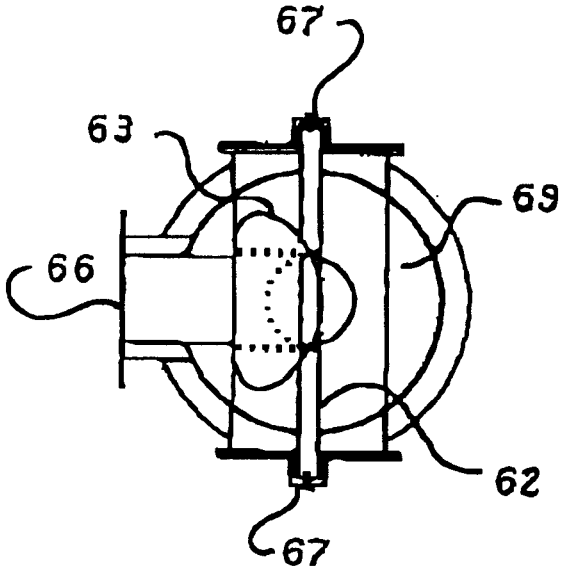
FIG. 30 is a top plan view, in section, of the rotary gate actuated dual stream valve illustrated in FIG. 29.

Referring to FIGS. 26 through 28, the general arrangement of the second embodiment of apparatus is illustrated with an thermal oxidizer 12 that is vertically oriented and a rotary gate assembly 60 substituted for slide gate assembly 13. Other components remain the substantially the same as identified in relation to the first embodiment and include blower motor 1, blower support 26, air filter 7, air blower inlet duct 23, blower 2, igniter 4, burner 5, combustion air line 9, secondary combustion air line 10, oxidizer 12, hot gas duct 16, reboiler 18, reboiled primary tube 22, still column 19, stack 17, still column gas line E, flash tank gas line O, and combined gas line C. Referring to FIGS. 29 and 30, the rotary gate assembly 60 is further illustrated the components of which include rotary gate support bracket 61, shaft 62, gate 64, first outlet 65, second outlet 66, shaft bearing 67, gas inlet flange 68, and refractory liner 69. Referring to FIG. 28, first outlet 65 communicates with rotary gate stack 65*a*.

Referring to FIGS. 1 and 26, the manner in which either the first embodiment or the second embodiment may be incorporated into a gas dehydration process will now be described. FIGS. 1 and 26, depict in simple terms the natural gas dehydration process. Natural gas saturated with water enters the contactor (45) at the bottom of the contactor from line P, travelling upwards in the contactor to exit the top of the contactor in line Q. The natural gas as it travels up the contactor will come in contact with a solution of ethylene glycol, or triethylene glycol or other glycol based liquid flowing down the contactor (45). This glycol based liquid enters the contactor (45) at the top of the contactor from line M via glycol transfer pump (44). The glycol based liquid when in contact with the natural gas will form a molecular bond with the water molecules in the natural gas to remove the water from the natural gas. The glycol based liquid will also come in contact with other molecules that are in the natural gas. This liquid will also absorb these molecules, such as hydrocarbons (C1 to C10), carbon dioxide, sulphide compounds, mercaptan compounds, benzene, toluene, ethyl benzene, xylene and other aromatic compounds that reside as naturally occurring molecules in the natural gas. Dehydrated natural gas, which is now almost completely free of water, exits the top to the contactor (45) in line Q. The glycol liquid, which now contains the water extracted from the natural gas and the other compounds mentioned above, exits the bottom of the contactor in line N and travels by the pressure exerted upon it by the pressure in the contactor (45) to a flash tank (43). The flash tank (43) depressurize the glycol liquid to a lower pressure and thus allows some of the water and some of the other molecule as mentioned above to escape from the glycol solution to be released from the flash tank in line O. The depressurized glycol solution exits the flash tank in line R and enters the still column (19). The still column (19) is a device that allows the depressurized glycol in line (R) to contact the gases leaving the reboiler (18) and to trap any vaporized glycol that may be exiting the reboiler (18). The still column (19) also transfers heat to the cold glycol liquid in line (R) from the vapours leaving the reboiler (18). The glycol liquid exits the still column (19) and enters the reboiler (18). In the reboiler the glycol is heated with hot gases from incinerator (12) through line H. The glycol liquid is heated to approximately 160 to 220 degrees Celsius in the reboiler (18) where all the water and all of the other molecules as described above are vaporized and released from the glycol liquid. These vapours enter the still column (19) from reboiler (18) and exit the still column (19) at line E. The glycol liquid, which is now free of water and other compounds exits the reboiler (18) in line K to enters the accumulator vessel (42). The accumulator vessel (42) allows for expansion and contraction of the glycol and provides a positive feed pressure for the glycol transfer pump (44). The glycol liquid exits the accumulator vessel (42) in line L and enter the glycol transfer pump (44) to be pumped back to the contactor (45) to complete the glycol cycle ready to capture more water and other compounds.

The gases that are released from the flash tank (43) and the still column (19) contain mainly water and other compounds such as hydrocarbons (C1 to C6), sulphide compounds, mercaptan compounds, benzene, toluene, ethyl benzene, xylene and other aromatic compounds. These compounds are directed to the burner (5) via lines O and E to be combined into line C. These gases are combined in burner (5 ) with air via line D supplies by blower (2) via filter (7) via line A and natural gas via line B. This mixture, as it passes the tip of the igniter S and enter the oxidizer (12), is ignited. In oxidizer (12) the molecules change from their original form to a new molecule form of water, oxides of carbon, oxides of sulphur and oxides of nitrogen. This process is called oxidation. In the process of oxidation and as the molecules change form, energy in the form of heat is released to the surrounding gases. These hot gases exit the oxidizer (12) in line F.

Figure 23:
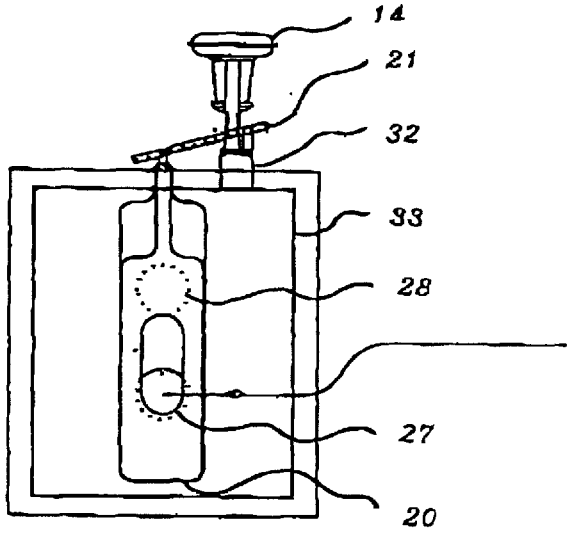
FIG. 23 is a front elevation view, in section, of the slide gate actuated dual stream valve illustrated in FIG. 4, with the slide gate in a first position.
Figure 25:
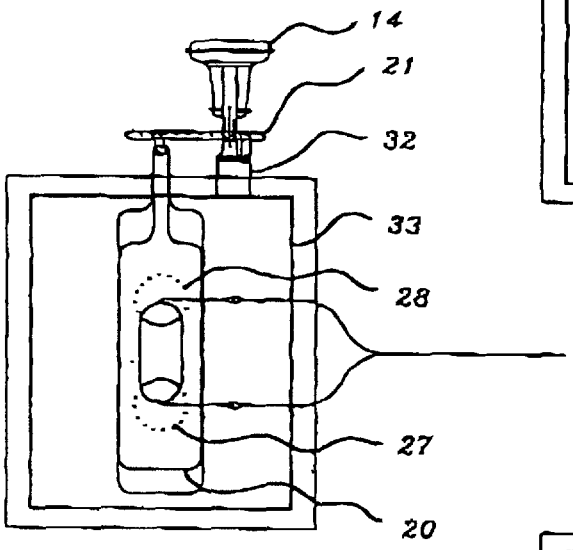
FIG. 25 is a front elevation view, in section, of the slide gate actuated dual stream valve illustrated in FIG. 4, with the slide gate in an intermediate position.
Figure 24:
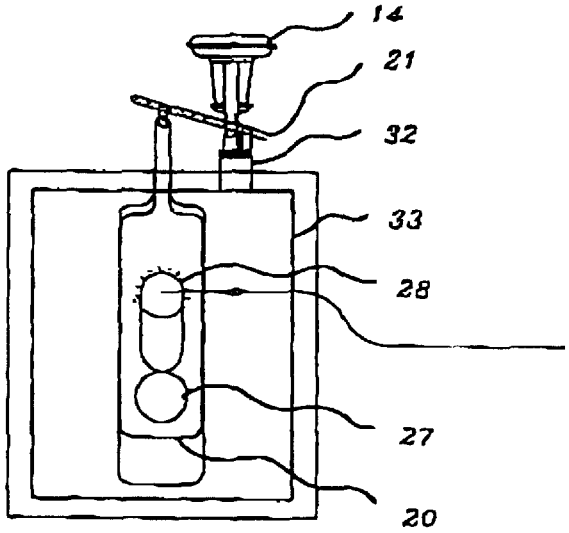
FIG. 24 is a front elevation view, in section, of the slide gate actuated dual stream valve illustrated in FIG. 4, with the slide gate in a second position.

As indicated above energy in the form of heat is required to raise the temperature of the cold glycol liquid as it exits the still column (19) and enters the reboiler (18). The energy that is required to heat the glycol to the desired temperature is dependent on the type of glycol used, the temperature of the incoming glycol, the amount of water and other compounds in the glycol and the overall thermal efficiency of the heat exchanger in the reboiler (18). The amount of energy in the form of heat released in the oxidizer (12) due to the oxidation of the gases from the still column (19) and from the flash tank (43) is greater than the energy required in the reboiler to heat the glycol liquid. In order to direct the appropriate amount of heat to the reboiler that is needed to heat the glycol a dual stream valve is used. Referring to FIG. 1, the dual stream valve used is the slide gate assembly (13) which is positioned between the oxidizer (12) and the reboiler (18). The slide gate assembly (13) receives hot gases from the oxidizer via line F and directs the appropriate amount of hot gas to the reboiler (18) as is required for the heating of the glycol. The slide gate assembly (13) then directs the remainder of the hot gases that are not required by the reboiler (18) to the exhaust stack (17) via line G. The actions of the slide gate assembly are controlled by inputs from the reboiler (18). The use of the slide gate assembly means that no additional fuel gas is required to provide energy to heat the glycol solution in that adequate waste energy which would normally go to atmosphere is available. Referring to FIGS. 23 through 25, it can be seen how slide gate 20 operates to direct exhaust gases through either first outlet 27 as illustrated in FIG. 23, second outlet 28 as illustrated in FIG. 24 or a combination of relative amounts through both first outlet 27 and second outlet 28 as illustrated in FIG. 25.

Figure 31:
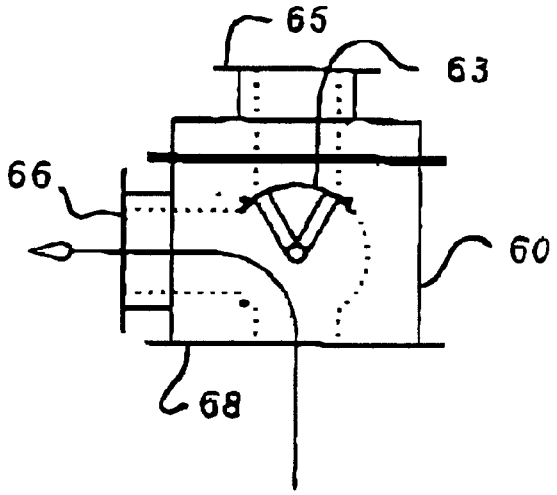
FIG. 31 is a left side elevation view, in section, of the rotary gate actuated dual stream valve illustrated in FIG. 29, with the rotary gate in a first position.
Figure 33:
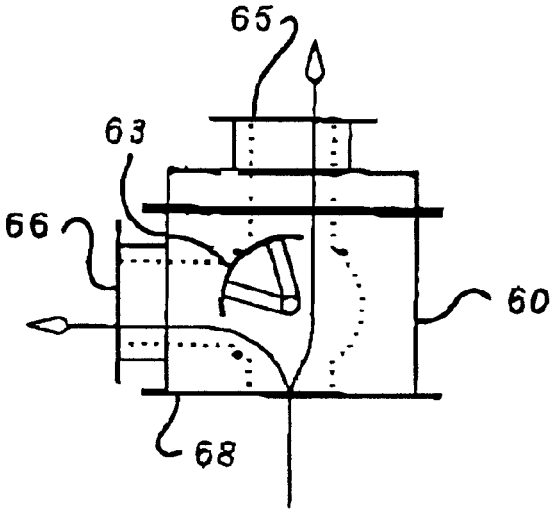
FIG. 33 is a left side elevation view, in section, of the rotary gate actuated dual stream valve illustrated in FIG. 29, with the rotary gate in a third or intermediate position.
Figure 32:
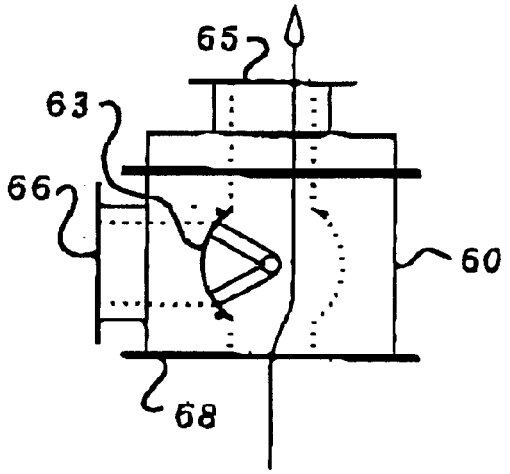
FIG. 32 is a left side elevation view, in section, of the rotary gate actuated dual stream valve illustrated in FIG. 29, with the rotary gate in a second position.

Referring to FIG. 26, the same object can be achieved through the use of rotary gate 64. The rotary gate assembly 60 works in a similar fashion as does the slide gate assembly to direct the products of oxidation from thermal oxidizer (12) to the reboiler (18) as required. Referring to FIGS. 31 through 33, it can be seen how rotary gate 64 operates to direct exhaust gases through either first outlet 65 as illustrated in FIG. 31, second outlet 66 as illustrated in FIG. 32 or a combination of relative amounts through both first outlet 65 and second outlet 66 as illustrated in FIG. 33

It will be apparent to one skilled in the art that modifications may be made to the illustrated embodiment without departing from the spirit and scope of the invention as hereinafter defined in the Claims.

The embodiments of the invention in which an exclusive property or privilege is claimed are defined as follows:

1. An apparatus for reclamation of a glycol based liquid used in gas dehydration, the apparatus comprising:

at least one gas/liquid separator for removing fugitive gas emissions from liquid containing glycol;

a thermal oxidizer in the form of an incinerator which is coupled to a fugitive gas emission line from the at least one gas/liquid separator whereby the thermal oxidizer oxidizes the fugitive gas emissions from the at least one gas/liquid separator, the thermal oxidizer having an exhaust gas outlet;

a dual stream valve having a single inlet coupled to the exhaust gas outlet of the thermal oxidizer, the dual stream valve having a first outlet, a second outlet and means for adjusting the relative flow of exhaust gases through the first outlet and the second outlet;

exhaust means coupled to the first outlet; and a reboiler coupled to the at least one gas/liquid separator whereby the liquid containing glycol can be introduced into the reboiler, the reboiler being coupled to the second outlet of the dual stream valve, such that exhaust gases diverted by the dual stream valve from the thermal oxidizer through the second outlet provide the heat necessary to operate the reboiler to boil the liquid containing glycol.

2. The apparatus as defined in claim 1, wherein the dual stream valve includes a housing having a first side, a second side and an interior cavity disposed between the first side and the second side, the first side having the single inlet, the second side having the first outlet and the second outlet, a slide gate with a flow aperture being positioned within the interior cavity of the housing between the single inlet and the first outlet and the second outlet such that all flow through the housing must pass through the flow aperture of the slide gate, the slide gate serving as means for adjusting the relative flow of exhaust gases through the first outlet and the second outlet, when the slide gate is slid in a first direction all of the flow through the flow aperture is directed through the first outlet, when the slide gate is slid in a second direction all of the flow through the flow aperture is directed through the second outlet, when the slide gate is maintained in a substantially central position the flow through the flow aperture is directed through both the first outlet and the second outlet.

3. The apparatus as defined in claim 1, wherein the dual stream valve includes a housing having a substantially cylindrical interior cavity, the housing having the single inlet, the first outlet and the second outlet all radially offset, a rotary gate being positioned within the housing between the single inlet and the first outlet and the second outlet, the rotary gate serving as means for adjusting the relative flow of exhaust gases through the first outlet and the second outlet, when the rotary gate is rotated to a third position the flow through the interior cavity is directed through both the first outlet and the second outlet.

4. An apparatus for reclamation of a glycol based liquid used in gas dehydration, the apparatus comprising:

at least one gas/liquid separator for removing fugitive gas emissions from a liquid containing glycol;

a thermal oxidizing incinerator being coupled to a fugitive gas emission line from the at least one gas/liquid separator, the thermal oxidizing incinerator having an exhaust gas outlet, and the thermal oxidizing incinerator, during operation, oxidizes the fugitive gas emissions from the at least one gas/liquid separator;

a dual stream valve having a single inlet coupled to the exhaust gas outlet of the thermal oxidizing incinerator, the dual stream valve having a first outlet, a second outlet and a movable gate for adjusting the relative flow of exhaust gases through the first outlet and the second outlet;

a flue stack coupled to the first outlet; and a reboiler being coupled to the at least one gas/liquid separator so that the liquid containing glycol is supplied to the reboiler, the reboiler being coupled to the second outlet of the dual stream valve such that exhaust gases diverted by the dual stream valve from the thermal oxidizing incinerator through the second outlet provide necessary heat to operate the reboiler to boil the liquid containing glycol and separate the glycol from a remainder of the liquid.

5. An apparatus, using natural gas as a primary energy source, for reclamation of a glycol based liquid used in gas dehydration, the apparatus comprising:

at least one gas/liquid separator for removing fugitive gas emissions from a liquid containing glycol;

a thermal oxidizing incinerator being coupled to a fugitive gas emission line from the at least one gas/liquid separator and using natural gas as at a portion of a primary energy source, the thermal oxidizing incinerator having an exhaust gas outlet, and the thermal oxidizing incinerator, during operation, oxidizes the fugitive gas emissions from the at least one gas/liquid separator;

a dual stream valve having a single inlet coupled to the exhaust gas outlet of the thermal oxidizing incinerator, the dual stream valve having a first outlet, a second outlet and a movable gate cooperating with high temperature seat for adjusting the relative flow of exhaust gases through the first outlet and the second outlet;

a flue stack coupled to the first outlet; and a reboiler being coupled to the at least one gas/liquid separator so that the liquid containing glycol is supplied to the reboiler, the reboiler being coupled to the second outlet of the dual stream valve such that exhaust gases diverted by the dual stream valve from the thermal oxidizing incinerator through the second outlet provide necessary heat to operate the reboiler to boil the liquid containing glycol and separate the glycol from a remainder of the liquid.

* * * * *